US006561965B1

(12) United States Patent
Corner-Walker et al.

(10) Patent No.: US 6,561,965 B1
(45) Date of Patent: May 13, 2003

(54) MIST PUMP FOR A DECANTER CENTRIFUGE FEED CHAMBER

(75) Inventors: Nicholas Corner-Walker, Oesterbro (DK); John W. Caldwell, Glenside, PA (US)

(73) Assignee: Alfa Laval Inc., Glen Allen, VA (US)

( * ) Notice: Subject to any disclaimer, the term of this patent is extended or adjusted under 35 U.S.C. 154(b) by 0 days.

(21) Appl. No.: 09/693,577

(22) Filed: Oct. 20, 2000

(51) Int. Cl.[7] ..... B04B 1/20; B04B 11/00

(52) U.S. Cl. ..... 494/53

(58) Field of Search ..... 494/50–55, 67; 210/377, 380.1, 380.3

(56) References Cited

U.S. PATENT DOCUMENTS

| | | | | |
|---|---|---|---|---|
| 981,758 | A | | 1/1911 | Goehler |
| 1,714,658 | A | | 5/1929 | Carter |
| 1,806,241 | A | | 5/1931 | Dupuis |
| 1,999,712 | A | | 4/1935 | Zorn et al. |
| 2,174,857 | A | * | 10/1939 | Vogel-Jorgensen |
| 2,243,697 | A | * | 5/1941 | Forsberg |
| 2,283,457 | A | | 5/1942 | Pecker |
| 2,403,089 | A | | 7/1946 | Lars |
| 2,600,372 | A | * | 6/1952 | Milliken et al. |
| 2,614,748 | A | | 10/1952 | Ritsch |
| 2,636,670 | A | | 4/1953 | Aspegren |
| 2,679,974 | A | * | 6/1954 | Gooch |
| 2,703,676 | A | * | 3/1955 | Gooch |
| 2,711,854 | A | | 6/1955 | Kjellgren |
| 2,733,856 | A | * | 2/1956 | Kjellgren |
| 2,919,848 | A | | 1/1960 | Howe |
| 3,087,621 | A | | 4/1963 | Gooch |
| 3,136,722 | A | * | 6/1964 | Gooch |
| 3,143,504 | A | | 8/1964 | Schneider |
| 3,182,802 | A | | 5/1965 | Gooch |
| 3,228,592 | A | * | 1/1966 | Shapiro |
| 3,228,594 | A | | 1/1966 | Amero |
| 3,235,174 | A | | 2/1966 | Downey |
| 3,275,230 | A | | 9/1966 | Hiller |
| 3,285,507 | A | | 11/1966 | Shapiro |
| 3,365,066 | A | * | 1/1968 | Howell |
| 3,368,684 | A | | 2/1968 | Rüegg |
| 3,405,866 | A | | 10/1968 | Amero |
| 3,428,246 | A | | 2/1969 | Finkelston |

(List continued on next page.)

FOREIGN PATENT DOCUMENTS

| | | | |
|---|---|---|---|
| DE | 1119173 | | 12/1961 |
| DE | 3723864 | * | 1/1989 |
| DE | 40 41 868 | | 7/1992 |
| EP | 0 177 838 | | 9/1985 |
| FR | 1387605 | * | 12/1964 |
| FR | 2057600 | | 4/1971 |
| GB | 372679 | | 5/1932 |
| GB | 1025079 | | 4/1966 |
| JP | 63-194759 | * | 8/1988 |
| JP | 63-194790 | * | 8/1988 |
| JP | 2-17990 | * | 1/1990 |
| RU | 385628 | | 6/1973 |
| RU | 612705 | | 6/1978 |
| SU | 1613174 | * | 12/1990 |
| WO | WO91/13686 | | 9/1991 |

*Primary Examiner*—Charles E. Cooley
(74) *Attorney, Agent, or Firm*—Drinker Biddle & Reath LLP

(57) ABSTRACT

The present invention is directed to a mist pump for a conveyor of a decanter centrifuge. The mist pump is incorporated into the feed chamber and prevents mist from leaving the feed zone and building up a layer of feed in the conveyor hub. The mist pump includes a plurality of vanes attached to, extending radially inward from and spaced about an interior surface of the sidewall of the feed chamber. The mist pump also includes a ring positioned coaxially about the longitudinal axis, attached to each of the pump vanes and spaced radially inward from the sidewall to provide a plurality of return openings defined by the ring and the sidewall.

63 Claims, 9 Drawing Sheets

U.S. PATENT DOCUMENTS 3,437,209 A 4/1969 Evans
3,447,742 A 6/1969 Eriksson et al.
3,467,304 A 9/1969 Jager
3,568,920 A * 3/1971 Nielsen
3,633,754 A 1/1972 Marsh
3,658,182 A 4/1972 Bye-Jorgensen et al.
3,795,361 A 3/1974 Lee
3,831,764 A * 8/1974 Humphrey
3,885,734 A 5/1975 Lee
4,714,456 A 12/1987 Bender et al.
4,731,182 A * 3/1988 High
4,816,152 A 3/1989 Kalleberg
4,978,370 A 12/1990 Klintenstedt
5,031,522 A * 7/1991 Brixel et al.
5,354,255 A 10/1994 Shapiro
5,364,335 A * 11/1994 Franzen et al.
5,374,234 A 12/1994 Madsen
5,380,266 A * 1/1995 Leung et al.
5,380,434 A 1/1995 Paschedag
5,484,521 A 1/1996 Kramer
5,509,882 A 4/1996 Caldwell
5,527,474 A * 6/1996 Leung
5,551,943 A 9/1996 Leung et al.
5,584,791 A 12/1996 Grimwood et al.
5,651,756 A * 7/1997 Leung
5,683,343 A * 11/1997 Leung
5,792,039 A * 8/1998 Green et al.
5,840,006 A * 11/1998 Leung et al.
5,971,907 A * 10/1999 Johannemann et al.

* cited by examiner

MIST PUMP FOR A DECANTER CENTRIFUGE FEED CHAMBER

FIELD OF THE INVENTION

The present invention relates to centrifuges and, particularly to decanter type centrifuges. The invention is directed to a pump within a feed chamber of the centrifuge conveyor that redirects mist generated during operation of the centrifuge from about a feed pipe and back into the feed chamber.

BACKGROUND OF THE INVENTION

A decanter centrifuge generally comprises an imperforate bowl mounted for rotation about its central longitudinal axis. The bowl typically includes a cylindrical section and a frusto-conical section at one end. A screw conveyor is coaxially mounted within the bowl and adapted for rotation at a differential speed with respect to the bowl. The screw conveyor typically comprises a coaxial central hub having a series of conveyor flights extending radially therefrom and forming a helix along the length of the hub.

The rotation of the bowl of the decanter centrifuge creates a centrifugal force which separates a liquid feed mixture or slurry into its constituent parts. The feed mixture within the bowl forms a cylindrical pond, with a ring or layer of the heavy constituent material(s) adjacent the inside bowl wall and a ring or layer of the lighter constituent material(s) radially inward of the heavy material layer.

A decanter centrifuge also includes a feed chamber which is typically incorporated within the conveyor hub. FIG. 1 illustrates a conventional feed chamber 2. The feed chamber 2 receives feed material from a feed pipe 4. The feed pipe 4 extends into the conveyor hub 6 and terminates within the feed chamber 2. As the feed material exits the feed pipe 4 it follows a path indicated by the arrows and engages an accelerator wall 8. As the feed material travels radially along the accelerator wall 8 it gradually accelerates. Thereafter, the feed material is transferred from inside the conveyor hub to the bowl 10 via passages 11. The accelerator wall 8 is generally smooth and allows the feed material to be brought up to speed relatively gently. In this configuration, the feed chamber 2 includes an entry wall 12 opposed to the accelerator wall 8. The entry wall 12 is defined by a frusto conical sidewall 14 and an end wall 16. The end wall 16 extends radially inward from the sidewall 14 to define an opening or bore 18 to the feed chamber 2.

In some instances, the volume rate of feed material to be accelerated becomes too great for the feed chamber and the feed material does not contact a sufficient amount of the accelerator wall 8 to bring the feed material up to speed quickly enough. In these instances, the feed material level increases radially inward causing feed material to move axially along the sidewall 14. Mist generated by the acceleration of the feed material or the feed material itself may overflow the feed chamber 2 into an adjacent portion 20 of the conveyor hub through the space between the feed pipe 4 and the end wall 16 of the feed chamber. If enough feed material accumulates in the conveyor hub to cause an unbalance in the conveyor, the decanter will shut down due to excessive vibration. Also, if the rotating feed material builds up in the space surrounding the feed pipe and contacts the stationary feed pipe 4, the feed pipe could potentially break. The configuration of FIG. 1 is shown as including vanes 22 extending from the sidewall 12. These vanes 22 are used to assist in accelerating the feed material up to speed and preventing overflow through the space surrounding the feed pipe 4 and into the conveyor hub. However, mist may still be created and move axially in the feed chamber and through this space, settling in a portion of the conveyor hub adjacent to the feed chamber.

One form of decanter centrifuge is shown in U.S. Pat. No. 3,885,734 to Lee. The centrifuge includes a conveyor that includes a central hub extending for a portion of the longitudinal length of the bowl. A feed pipe extends along the axis of the conveyor terminating in a feed chamber within the hub. A feed slurry is introduced into the feed chamber via the feed pipe. The slurry engages an accelerator vane for imparting radial and tangential velocity to the slurry. Once the slurry is brought up to speed, it is discharged out of the feed chamber through a feed passage and into the centrifuge bowl. The centrifuge also includes a partition within the hub about the feed pipe and an annular seal (not shown) that closes the space between the partition and the feed pipe.

U.S. Pat. No. 5,551,943 to Leung et al. discloses a decanter centrifuge including a feed pipe, positioned at one end of the conveyor hub. The feed chamber is separated from an adjacent portion of the conveyor hub by a feed pipe baffle. The feed pipe baffle is positioned toward one end of the conveyor hub and is provided to prevent the feed slurry from flowing from the feed chamber, back along the inside surface of the conveyor hub and into the adjacent portion of the conveyor hub.

U.S. Pat. No. 3,428,246 to Finkelston discloses a centrifuge including a feed chamber having a baffle plate that extends axially from an interior circumferential surface of the conveyor hub towards, but not abutting, a feed tube. A first annular member extends radially outward from the feed tube. A second annular member extends radially inward from the baffle plate. Each of the radially extending members includes a radially extending flange. The radially extending flanges are positioned in an overlapping relationship so as to provide a deflector assembly which is intended to guard against the passage of feed toward a chamber on the opposite side of the baffle.

U.S. Pat. No. 5,354,255 to Shapiro discloses a decanter centrifuge including a feed tube mounted within a conveyor hub that terminates within an open feed chamber. The feed chamber is separated from an adjacent hub section by a baffle plate. A plurality of vanes extend from the baffle plate into the feed chamber. The vanes redirect feed material traveling axially along the feed tube away from the accelerator portion.

U.S. Pat. No. 3,405,866 to Amero discloses a centrifuge including a main feed compartment and a secondary feed compartment inside the conveyor hub. A baffle acts as a splash guard separating the main feed compartment from the secondary feed compartment. The feed pipe passes through an opening within the baffle.

U.S. Pat. No. 4,816,152 to Kalleberg discloses a separator including an inlet pipe terminating in a receiving compartment. The receiving compartment includes impeller plates positioned about the inlet pipe. The rotating impeller plates force excess feed liquid back into the receiving compartment and out of holes positioned in the upper wall of the receiving compartment.

SUMMARY OF THE INVENTION

The invention relates to centrifuges and is preferably directed to a mist pump for a decanter centrifuge conveyor adapted for rotation about its longitudinal axis. The conveyor includes a feed chamber housing the mist pump. The feed chamber comprises a sidewall and a lip extending radially inward from a distal end of the sidewall. The sidewall includes an interior surface and is coaxially positioned about the longitudinal axis of the conveyor. The lip terminates at a circumferential surface, the circumferential surface defining an opening to the feed chamber. The feed chamber also includes a ring wall defined by an inner diameter defining an opening in the ring wall and an outer diameter. The ring wall is normal to the longitudinal axis, parallel to the lip and spaced radially inward from the sidewall. The feed chamber further includes a plurality of vanes positioned between and connected to the ring wall and the lip, the vanes being spaced radially inward from the sidewall.

The mist pump of the present invention may be incorporated into an existing feed chamber for redirecting mist, generated during acceleration of the feed material that gravitates towards a portion of the conveyor hub adjacent to the feed chamber.

In addition to the centrifuges that utilize an enclosed feed chamber, there are also conveyors, for example a conveyor described in U.S. Pat. No. 5,354,255 (incorporated herein by reference), that use an open feed chamber to reduce sudden feed acceleration. The open feed chamber allows the liquid to reach the pond without contacting feed passages or vanes between the feed chamber and the bowl. While these types of centrifuges allow the feed material to more gradually and smoothly achieve a desired speed than closed chamber configurations, mist may still be generated in the feed chamber. The present invention is intended to operate with both closed and open feed chamber centrifuges.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
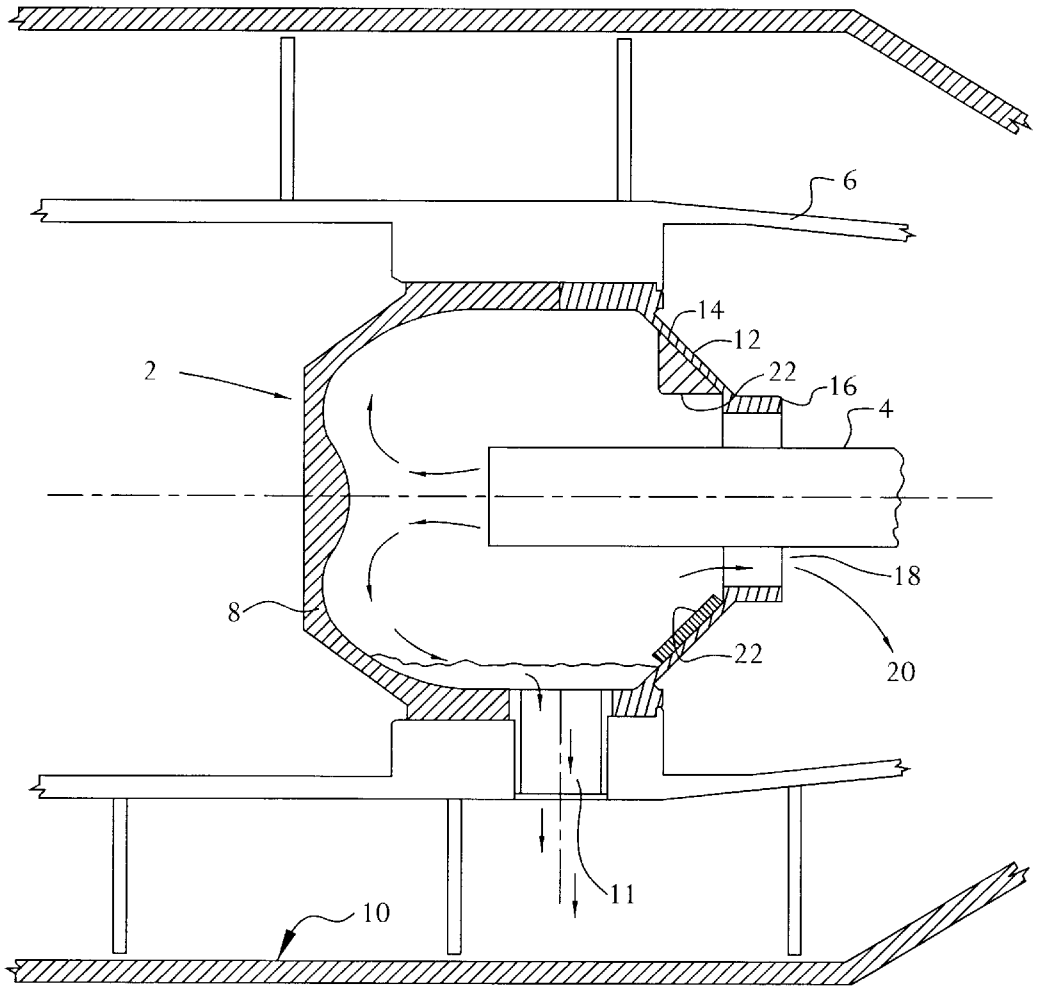
FIG. 1 PRIOR ART
FIG. 1 illustrates a side section view of a conventional centrifuge conveyor including a feed chamber and a feed pipe.

In the drawings, wherein like numeral indicate like elements, there is shown a decanter centrifuge incorporating a feed chamber mist pump of the present invention.

Figure 2:
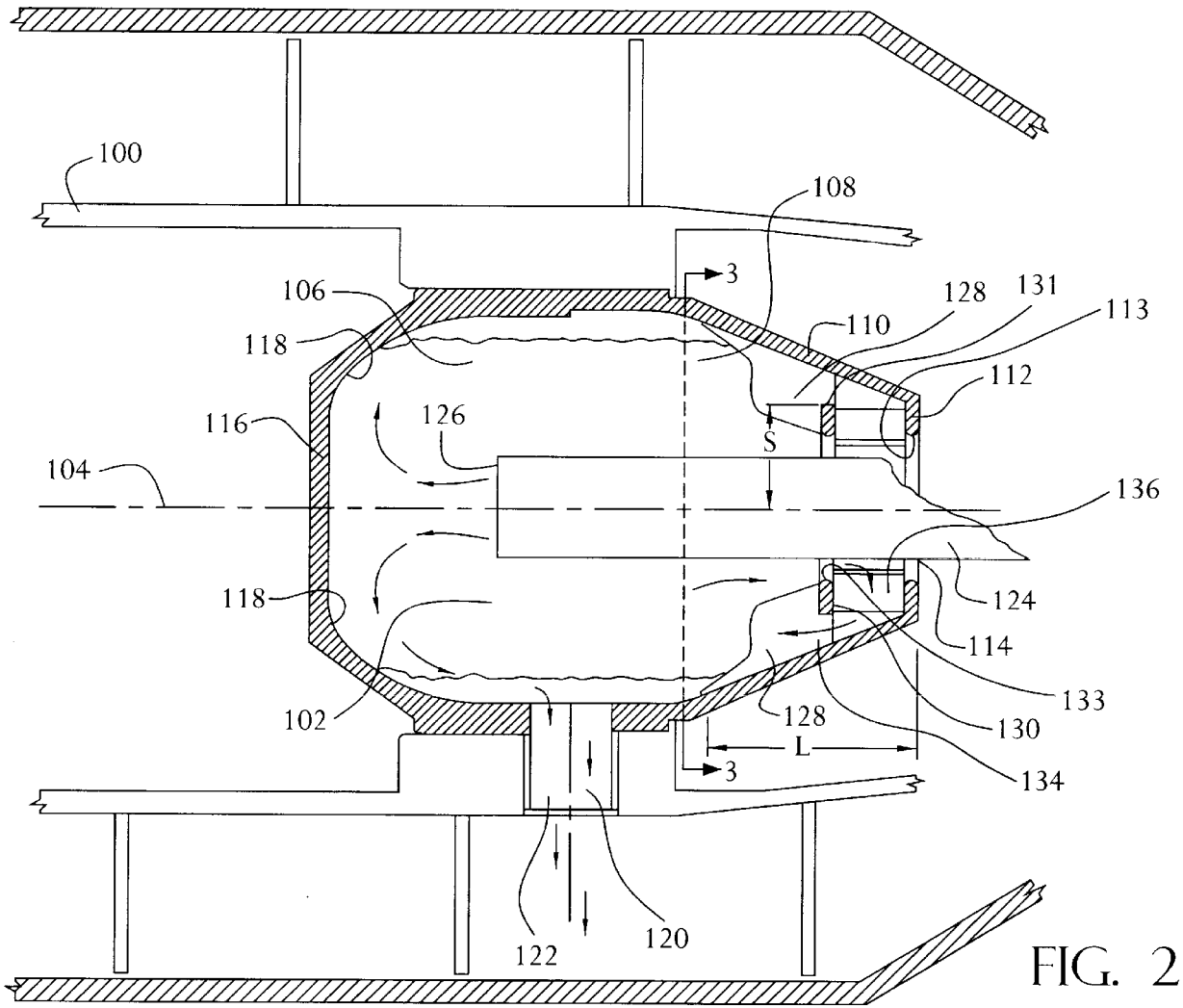
FIG. 2 illustrates a side section view of a conveyor incorporating the present invention.

With reference to FIG. 2, the mist pump of the present invention is incorporated into a conveyor hub 100 of a decanter type centrifuge. The conveyor hub 100 houses a feed chamber 102 that is positioned along and rotates about a longitudinal axis 104 of the conveyor hub 100. The feed chamber 102 includes an accelerator portion 106 and a feed zone portion 108. The feed zone portion 108 is defined by a continuous, closed sidewall 110 coaxially positioned about the longitudinal axis 104. The sidewall 110 may be cylindrical, barrel shaped, or frusto-conical. The sidewall 110 has first end located at the intersection of the accelerator portion 106 and the feed zone portion 108 and a second end terminating in a lip or collar 112. The lip 112 extends radially inward from the sidewall 110 and terminates at an interior, circumferential surface 113. The circumferential surface 113 defines an opening 114 to the feed zone portion 108 of the feed chamber 102. The accelerator portion 106 is defined by a cap type end wall 116. The end wall 116 includes an interior contact surface 118.

At or about the intersection of accelerator portion 106 and the feed zone portion 108 are feed holes 120. The feed holes 120 lead to nozzles 122. The feed material exits the feed chamber 102 and travels to a pond (not shown) of the centrifuge via the nozzles 122. As stated above, both closed feed chamber and open feed chamber centrifuges may incorporate the present invention. FIG. 2 illustrates portions of a closed feed chamber centrifuge and presents an example of the present invention. However, an open feed chamber centrifuge, for example one illustrated and described in U.S. Pat. No. 5,354,255, may also incorporate the present invention in a similar manner.

The centrifuge also includes a feed pipe 124 positioned coaxially along the longitudinal axis 104. The feed pipe 124 extends into the feed chamber 102 through the opening 114 defined by the inner surface of the lip 112 and terminates in the accelerator portion 106. A first end 126 of the feed pipe 124 is spaced from the contact surfaces 118. Feed material is supplied to the feed chamber 102 through the feed pipe 124. As the feed material exits the feed pipe 124, at the first end 126, it travels toward the contact surfaces 118. As the feed material engages the contact surfaces 118 it is forced radially outward along the contact surface 118 and is accelerated up toward the desired speed.

As shown in FIG. 2, the end wall 116 is flat at the center of the contact surfaces 118. It should be noted however that the target may be bulbous or otherwise project outwardly from the wall (such as, for example, in the form shown in FIG. 1).

Figure 3:
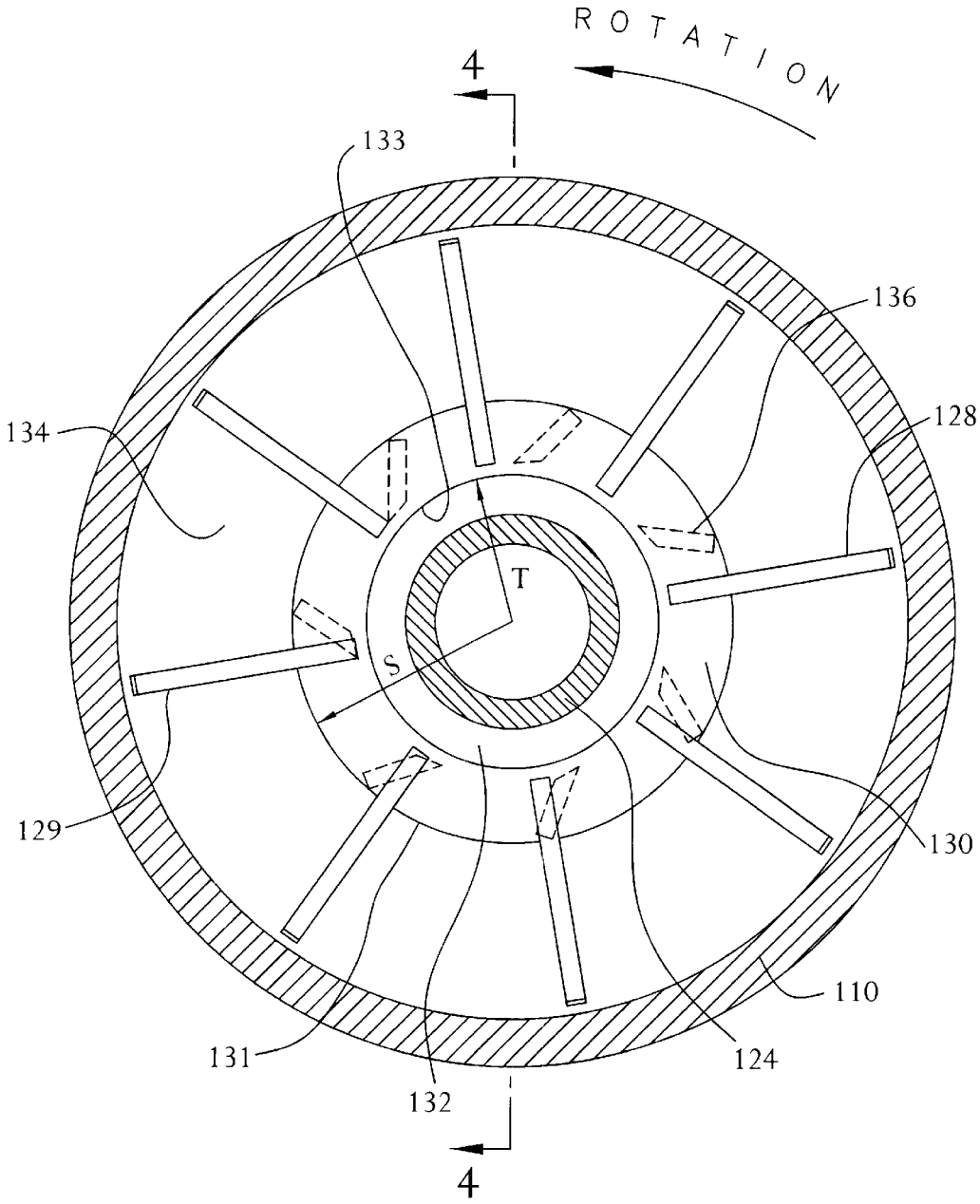
FIG. 3 illustrates a sectional view of a mist pump of the present invention as seen along line 3—3 in FIG. 2 without a feed pipe.
Figure 4:
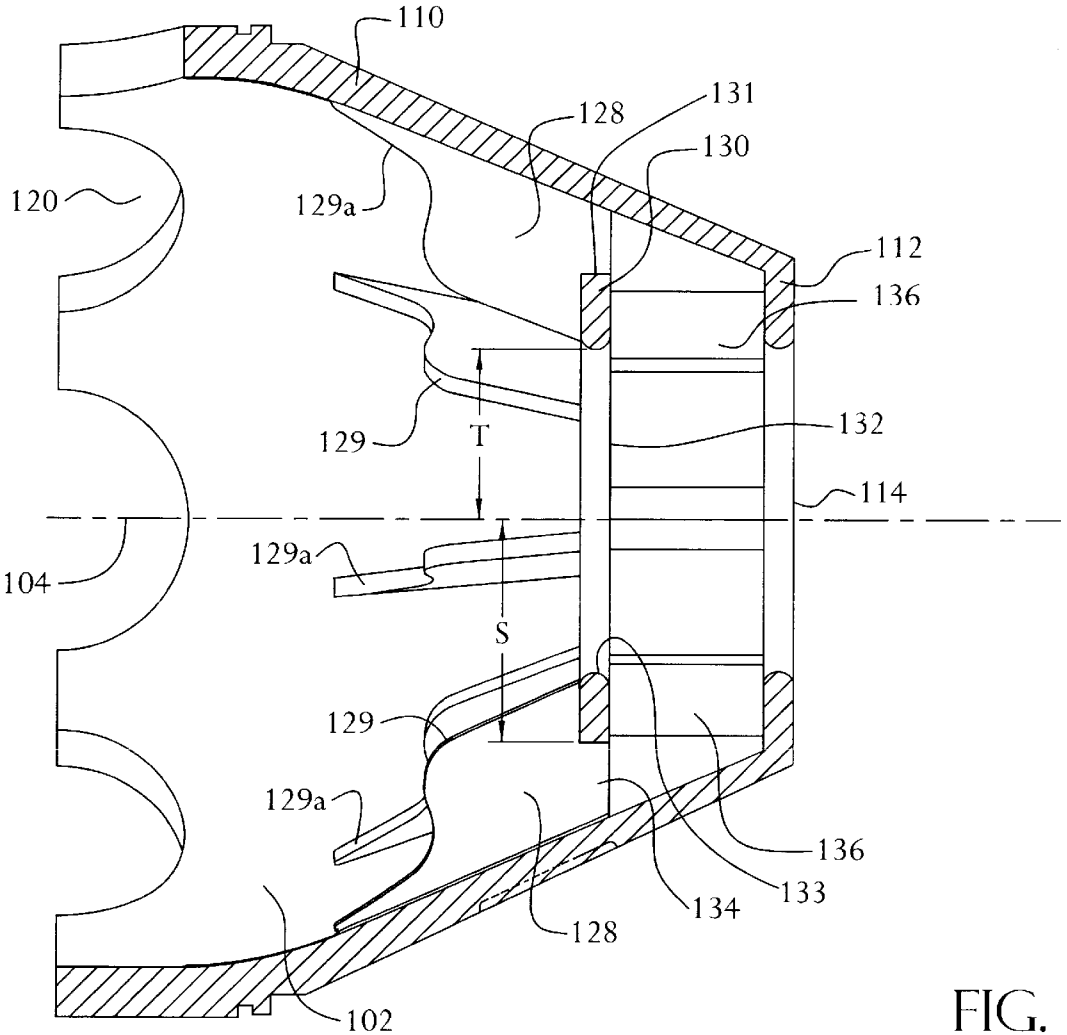
FIG. 4 illustrates a more detailed view of the present invention as illustrated in FIG. 2 along line 4—4 of FIG. 3.
Figure 8:
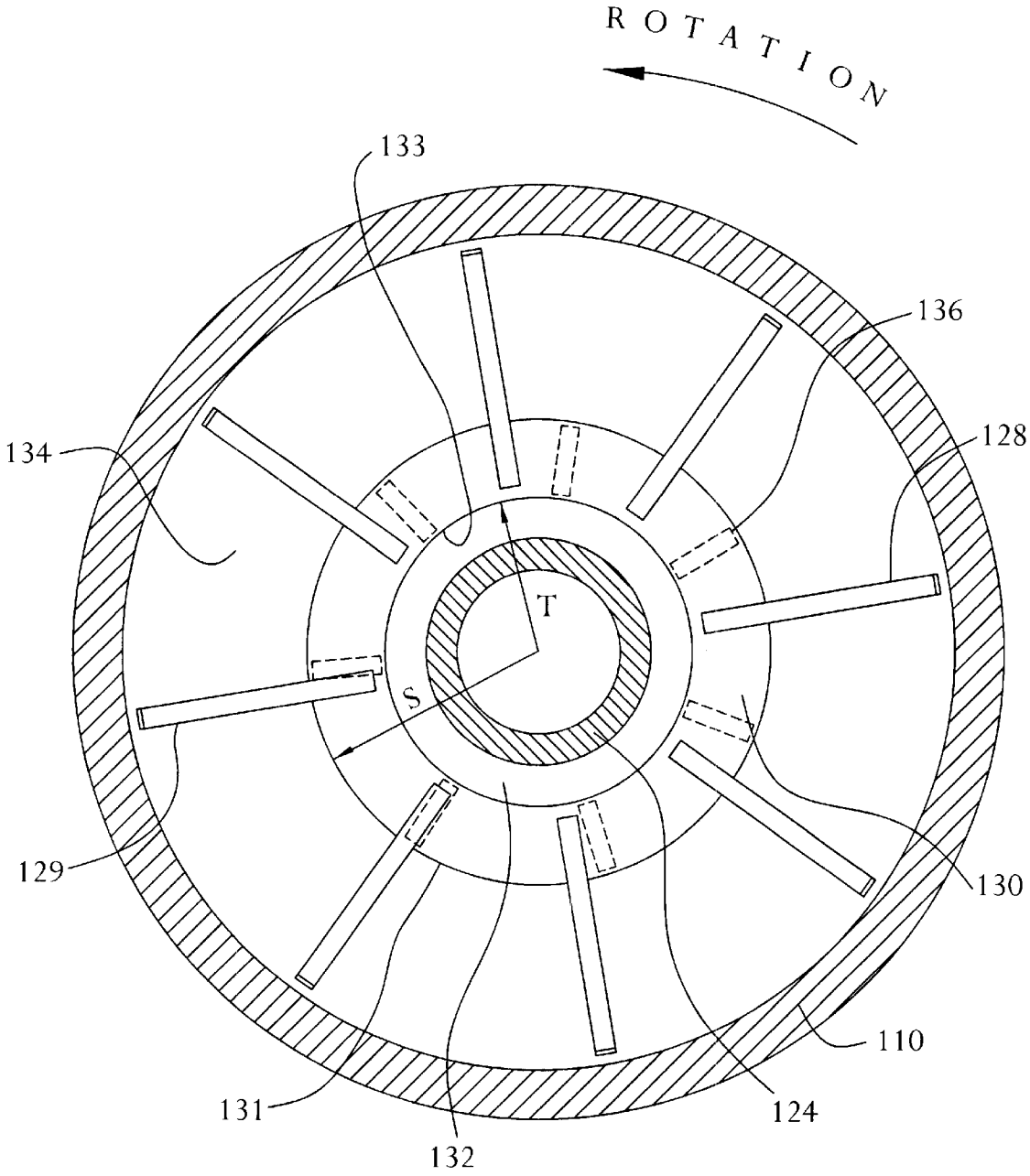
FIG. 8 shows the pump vanes and accelerating vanes intersecting the longitudinal axis of the feed chamber.
Figure 9:
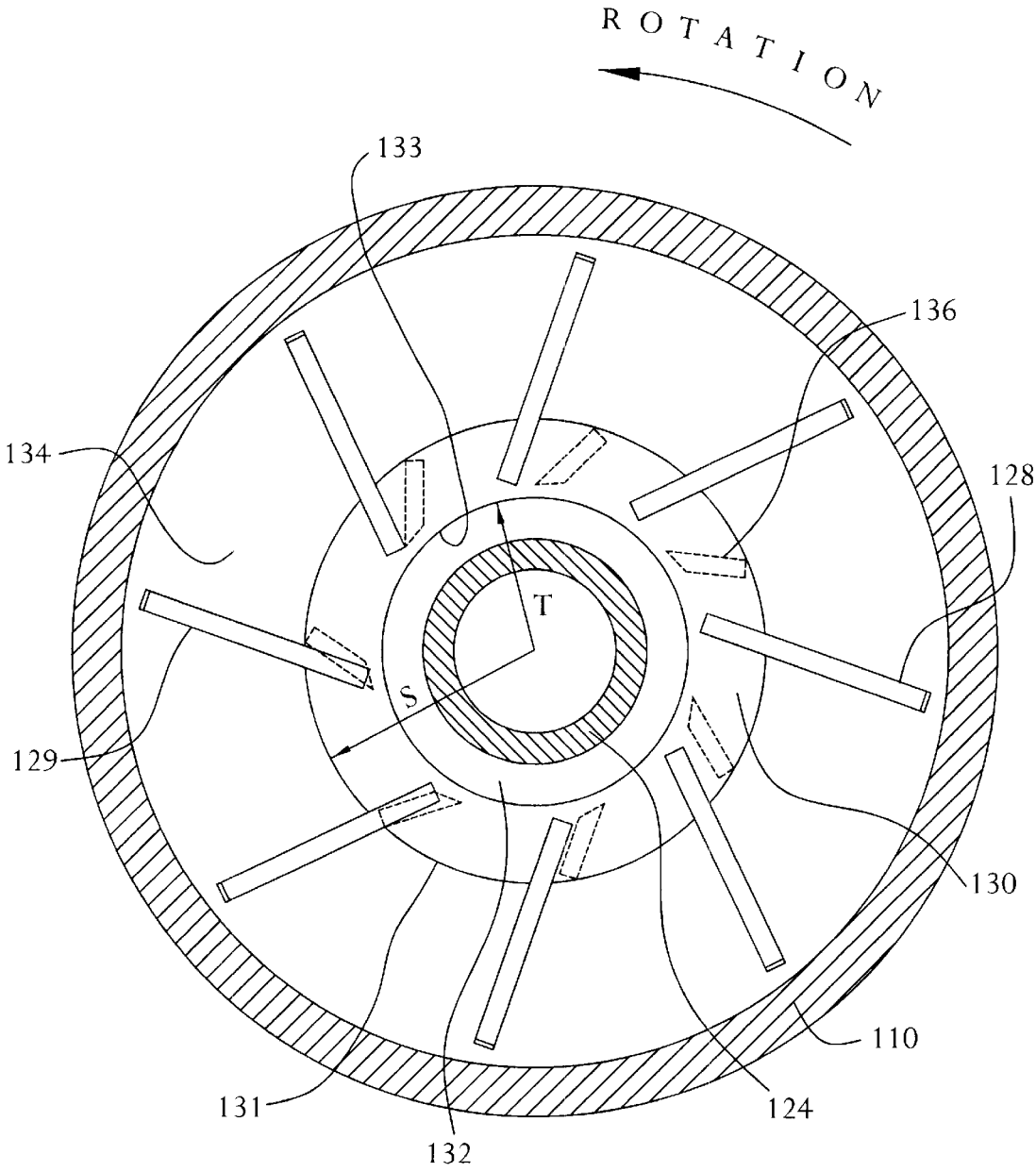
FIG. 9 shows the pump vanes and accelerating vanes parallel to the longitudinal axis of the feed chamber.
Figure 10:
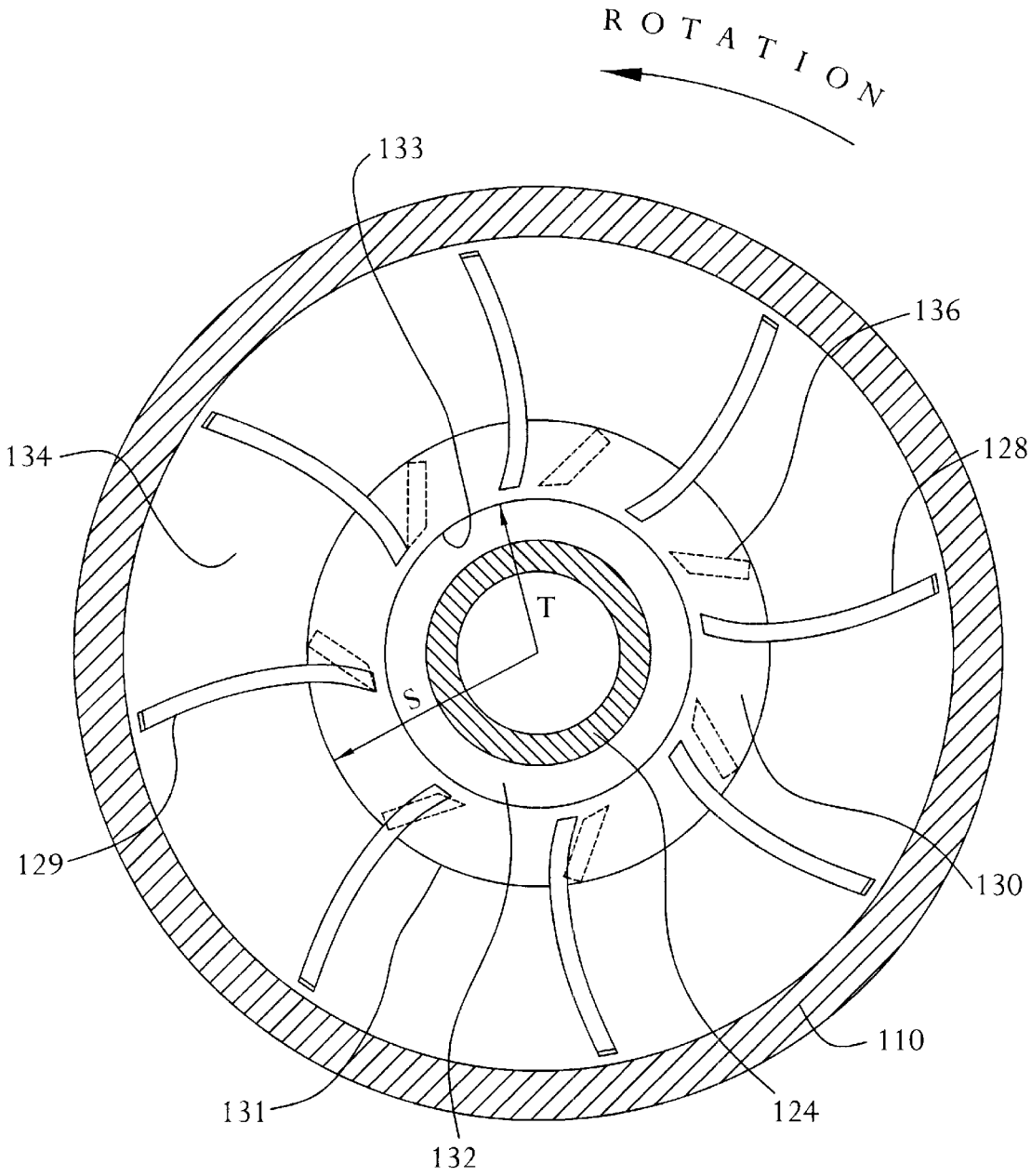
FIG. 10 shows the accelerating vanes as curved.
Figure 11:
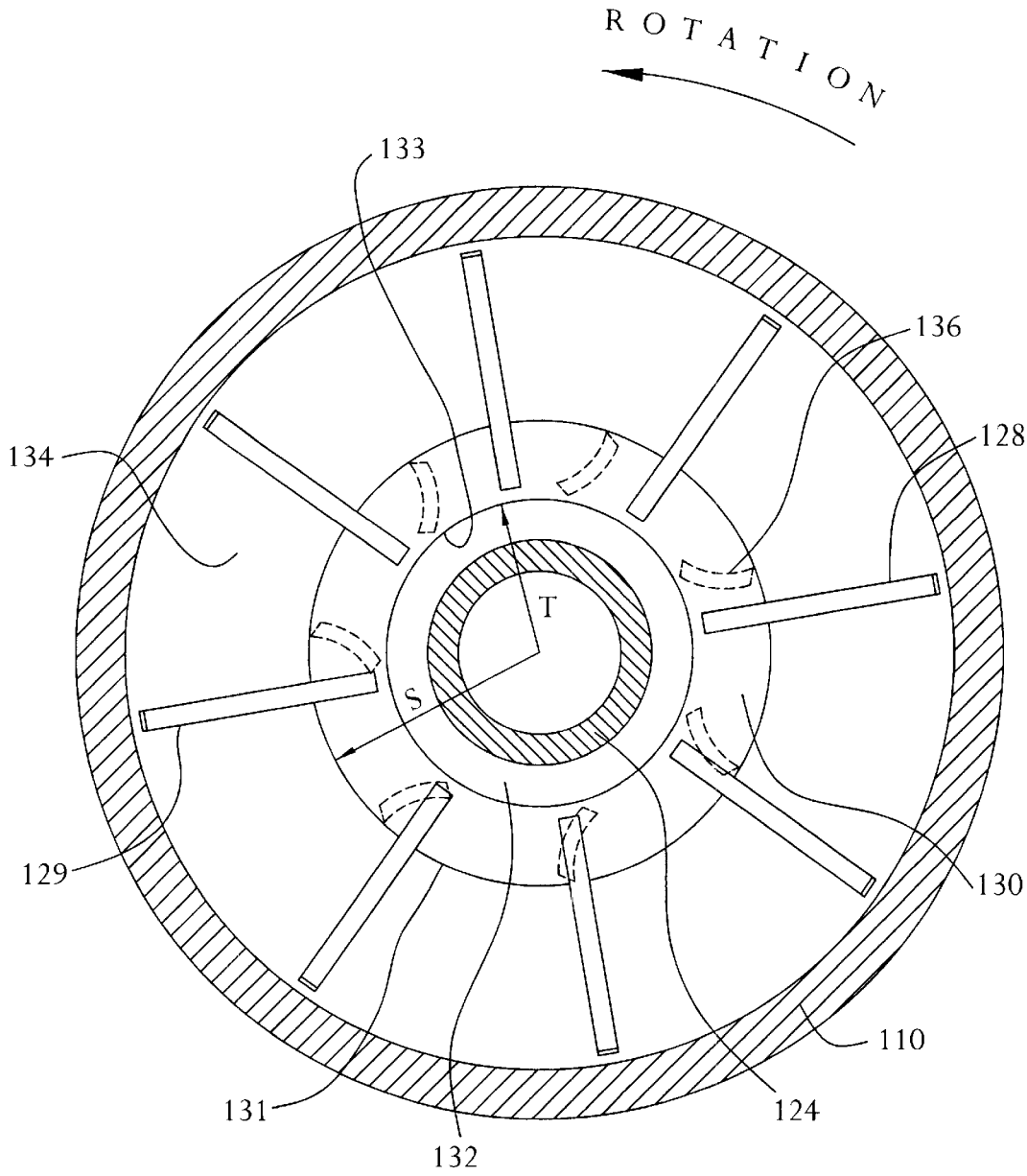
FIG. 11 shows the pump vanes as curved.

FIG. 3 illustrates a view looking into the feed zone portion 108 from the contact surfaces 118. The feed zone portion 108 houses the mist pump of the present invention. FIG. 4 also shows the feed zone portion 108, but does not include the feed pipe 124 in order to provide a better view of the mist pump. The feed zone portion of the present invention includes a plurality of accelerating vanes 128. As illustrated in FIG. 2, the accelerating vanes 128 extend radially inward from an interior surface of the liner sidewall 110. These vanes 128 serve primarily to accelerate the feed material up to the desired speed. In a preferred embodiment, there are eight accelerating vanes 128 and they are spaced equally about the feed zone portion 108. The vanes as illustrated are substantially straight. However, curved pump and/or accelerating vanes may also be utilized (shown in FIGS. 10 and 11). Accelerating and/or pump vanes may be oriented so that they intersect the longitudinal axis of the feed chamber (FIG. 8) or are parallel to the longitudinal axis of the feed chamber (FIG. 9).

The mist pump includes a ring or pump wall 130. The ring wall 130 is positioned normal to and coaxially with the longitudinal axis 104. The ring wall 130 has an exterior, circumferential surface 131 having a radius S. The radius S is less than the interior radius of the sidewall 110 along the plane of the ring wall 130 resulting in an annular space between the ring wall 130 and the sidewall 110. The ring wall 130 also has an interior, circumferential surface 133 having a radius T. The interior, circumferential surface 133 defines an opening 132 in the ring wall 130. The ring wall 130 is attached to a distal end of each of the plurality of accelerating vanes 128. A plurality of return openings 134 are formed between adjacent accelerating vanes 128, the ring wall 130 and the sidewall 110 in the annular space between the ring wall 130 and the sidewall 110.

As illustrated in FIG. 4, each of the accelerating vanes 128 has an inner perimeter surface 129. The distance between the inner, surface 129 and the sidewall 110 is smallest at an end 129*a* of the vanes closest to the feed holes 120 and accelerator portion 106. This distance increases gradually, moving in a distal direction for approximately one-third of the vane. At this point, the distance between the inner, perimeter surface 129 and the sidewall 110 increases abruptly and thereafter remains constant until the vane abuts the ring wall 130. The abrupt increase is intended to prevent the level of feed material in the feed chamber 102 from reaching the exterior, circumferential surface 131 of the ring wall 130. This prevents the feed material from blocking the return openings 134. Although the accelerating vanes 128 have been described with the specific shape shown, they may be constructed in many other shapes and sizes according to the volume and density of the feed material. In addition, the accelerating vanes may be oriented so that they are in a plane including the longitudinal axis 104, as illustrated in FIGS. 3 and 4 or so that they are in a plane intersected by the longitudinal axis 104. In addition, the end 129*a* of vanes 128 may be extended back into the feed chamber 102 for any desired distance, including passing over the feed holes 120. Moreover, the number, shape, and curvature of these vanes 128 may vary as desired.

The mist pump includes a plurality of pump vanes 136. The pump vanes 136 are positioned between and attached to the pump wall 130 and the lip 112. The pump vanes 136 are spaced apart from each other about the longitudinal axis 104 of the feed chamber 102. As illustrated in FIG. 4, in a preferred embodiment there are seven pump vanes 136, each of the pump vanes 136 is positioned at a 45° angle to a plane radiating from the longitudinal axis 104. Referring to FIG. 2, based upon the rotation of the conveyor (see direction of rotation indicated by arrow A illustrated in FIG. 3) the mist pump vanes 136 draw mist from the area about the feed pipe 124, between the ring 130 and the lip 112, through the return openings 134 and back into the feed chamber 102 during rotation of the conveyor. By drawing mist away from the feed pipe 124, the mist pump prevents feed material from accumulating between the feed pipe 124 and the lip 112. The mist pump prevents feed material from traveling along the feed pipe 124 to a compartment outside of the feed chamber. In effect, the mist pump provides a seal between the feed chamber and an adjacent, distal chamber without requiring a physical seal, for example a gasket, between the feed pipe 124 and the lip 112. The mist pump vanes 136 may be oriented so that they are in a plane parallel to or including the longitudinal axis 104 or so that they are in a plane intersected by the longitudinal axis 104. Further, the mist pump and/or accelerating vanes may be curved or turned in any manner desired. As seen in FIGS. 2 and 5–7, an unobstructed annular area is defined between the radially inner surface of the pump vanes 136 and the feed pipe 124. The annular area extends from the sidewall opening 114 to a distal end of the pump vanes 136.

Figure 5:
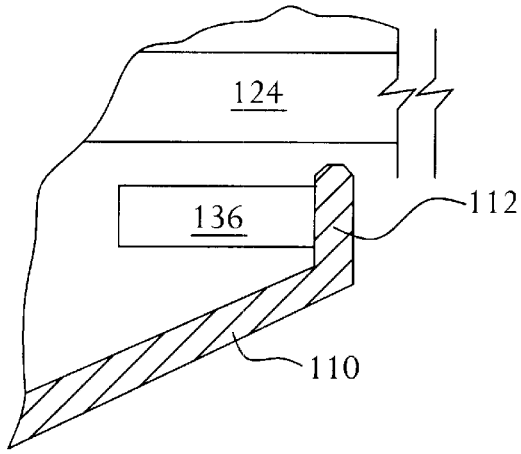
FIG. 5 illustrates an alternate embodiment of the invention.

FIG. 5 shows an alternate embodiment of the invention having a pump vane 136 mounted on a lip 112 that extends from the sidewall 110. This embodiment shows the minimum elements of the invention necessary to achieve the desired result of preventing the feed material from traveling along the feed pipe 124 to a compartment outside the feed chamber (the feed pipe and feed chamber being shown in detail in FIG. 2).

Figure 6:
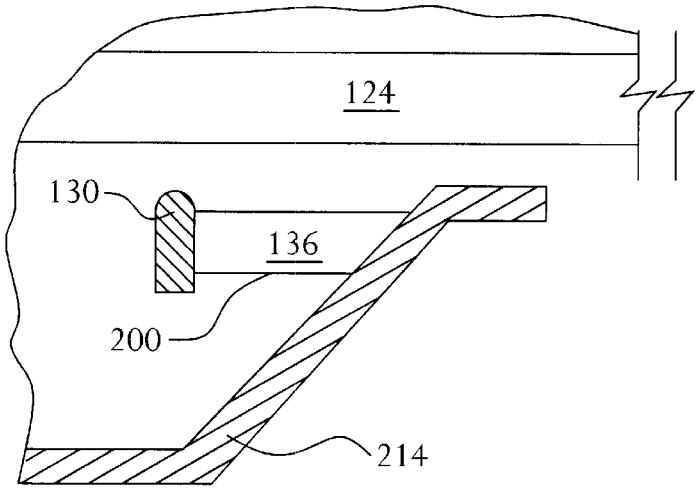
FIG. 6 illustrates a further embodiment of the invention.

FIG. 6 shows another alternate embodiment of the present invention. The pump vanes 136 are mounted on the sidewall 214 of the feed chamber. The particular benefit of this embodiment is that the mist pump of the invention may be mounted on the sidewall 14 (FIGS. 5, 6, and 7) of the feed chamber in an existing conveyor. In this embodiment, the pump vanes 136 are attached to the ring wall 130.

Figure 7:
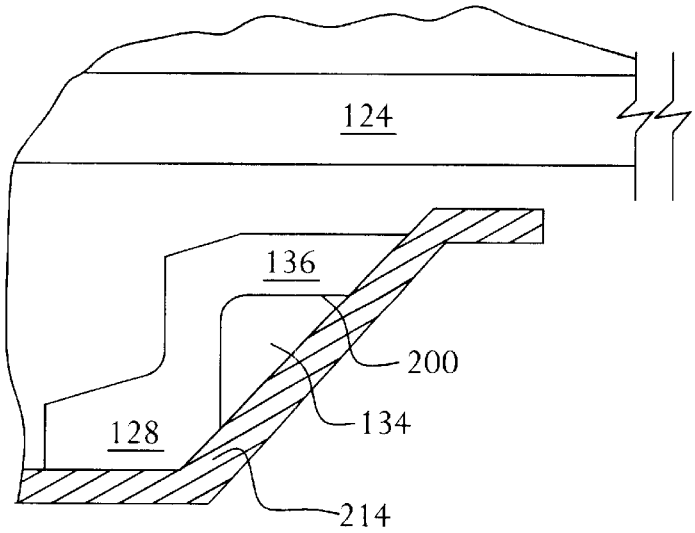
FIG. 7 illustrates a still further embodiment of the present invention.

In a further embodiment, FIG. 7 shows the accelerating vanes 128 attached to the pump vanes 136. Again, the mist pump of this embodiment may be mounted on the feed chamber sidewall 214 of an existing centrifuge conveyor, if desired.

In the embodiment shown in FIG. 6, the outer edge 200 of the pump vane 136 is the return opening for mist. In FIG. 7, the return opening 134 for mist is between the pump vane 136 and the accelerating vane 128.

The present invention may be embodied in other specific forms without departing from the spirit or essential attributes thereof and, accordingly, reference should be made to the appended claims, rather than to the foregoing specification, as indicating the scope of the invention.

What is claimed is:

1. A decanter centrifuge for applying centrifugal force to a feed mixture, the centrifugal force created by rotation of the centrifuge, the centrifuge comprising:

a bowl rotatable about its longitudinal axis, the bowl having discharge ports therein;

a feed pipe for introducing the feed mixture into the bowl; and a rotatable conveyor mounted within the centrifuge bowl and adapted for rotation at a differential speed with respect to the bowl, the conveyor having a central hub extending for at least a portion of the longitudinal length of the centrifuge, a helical conveyor flight extending along at least a portion of the length of the hub, and a feed chamber within the hub for receiving a feed mixture from the feed pipe, the feed chamber delivering the feed mixture into the bowl, the feed chamber having a sidewall including an interior surface and being coaxially positioned about the longitudinal axis, an opening in the feed chamber sidewall for receiving the feed pipe, a space defined between the feed pipe and the opening, and a plurality of pump vane means located radially inward from a portion of the sidewall and defining a space between a radially outer surface of the pump vane means and an inner surface of the sidewall adjacent the sidewall opening for providing a centrifugal force to the feed mixture as the pump vane means rotate along with the conveyor about the longitudinal axis and for drawing the feed mixture from the space between the feed pipe and the sidewall opening and returning the feed mixture into the space between the sidewall and the radially outer surface of the pump vane means and back into the feed chamber radially outward from the pipe, an unobstructed annular area defined between the radially inner surface of the pump vane means and the feed pipe extending from the sidewall opening to a distal end of the pump vane means.

2. A decanter centrifuge as recited in claim 1 further comprising:

a lip extending radially inward from a distal end of the sidewall, the lip terminating at a circumferential surface, the circumferential surface defining the opening to the feed chamber.

3. A decanter centrifuge as recited in claim 1 further comprising:

a ring wall having an inner diameter surface defining an opening and an outer diameter surface, the ring wall positioned normal to the longitudinal axis and spaced radially inward from the sidewall, and the ring wall connected to the pump vane means; and an annular space defined between the ring wall outer diameter surface and the sidewall interior surface.

4. A decanter centrifuge as recited in claim 1 further comprising:

a lip extending radially inward from a distal end of the sidewall, the lip terminating at a circumferential surface, the circumferential surface defining the opening to the feed chamber, the pump vane means mounted on the lip;

a ring wall having an inner diameter surface defining an opening and an outer diameter surface, the ring wall positioned normal to the longitudinal axis, parallel to the lip, spaced radially inward from the sidewall, and connected to the pump vane means; and an annular space defined between the ring wall outer diameter surface and the sidewall interior surface.

5. A decanter centrifuge as recited in claim 4, further comprising a plurality of accelerating vanes extending radially inward from the interior surface of the sidewall of the feed chamber, the accelerating vanes being connected to the interior surface of the sidewall, the accelerating vanes providing a centrifugal force to the feed mixture as the feed chamber rotates.

6. A decanter centrifuge as recited in claim 5, wherein the accelerating vanes are oriented in a plane including the longitudinal axis.

7. A decanter centrifuge as recited in claim 5, wherein the accelerating vanes are oriented in a plane intersected by the longitudinal axis.

8. A decanter centrifuge as recited in claim 5, wherein the accelerating vanes are oriented in a plane parallel to the longitudinal axis.

9. A decanter centrifuge as recited in claim 5, wherein the accelerating vane means are curved.

10. A decanter centrifuge as recited in claim 4, wherein the pump vane means are curved.

11. A decanter centrifuge as recited in claim 1, wherein the pump vane means are oriented so that the pump vane means are in a plane including the longitudinal axis.

12. A decanter centrifuge as recited in claim 1, wherein the pump vane means are oriented so that the pump vane means are in a plane parallel to the longitudinal axis.

13. A decanter centrifuge as recited in claim 1, wherein the pump vane means are oriented so that the pump vane means are in a plane intersected by the longitudinal axis.

14. A decanter centrifuge as recited in claim 1 further comprising: a ring wall having an inner diameter surface defining an opening and an outer diameter surface, the ring wall positioned normal to the longitudinal axis and spaced radially inward from the interior surface of the sidewall, the ring wall being connected to the pump vane means, and the pump vane means being connected to the sidewall.

15. A decanter centrifuge as recited in claim 1 further comprising:

a plurality of accelerating vane means extending radially inward from the interior surface of the sidewall and being connected to the pump vane means, the accelerating vane means providing centrifugal force to the feed mixture as the feed chamber rotates.

16. A decanter centrifuge as recited in claim 1, wherein the pump vane means are curved.

17. A mist pump for use in a feed chamber within a conveyor of a decanter centrifuge, the feed chamber positioned within a central hub of the conveyor, the feed chamber receiving a feed mixture from a feed pipe, the feed chamber having a sidewall coaxially positioned along the longitudinal axis of the centrifuge, an opening in the sidewall for receiving the feed pipe, and a space defined between the feed pipe and the opening, the mist pump comprising:

a plurality of pump vane means positioned and spaced radially inward from a portion of the sidewall of the feed chamber adjacent to the feed pipe and the sidewall opening for providing a centrifugal force to the feed mixture as the pump vane means rotate and for directing the mixture in the area of the space between the feed pipe and the sidewall opening into the space between the pump vane means and interior surface of the feed chamber and back into the feed chamber, an unobstructed annular area defined between the radially inner surface of the pump vane means and the feed pipe extending from the sidewall opening to a distal end of the pump vane means.

18. A mist pump as recited in claim 17, further comprising: a lip extending radially inward from one end of the sidewall, the lip terminating at a circumferential surface, the circumferential surface defining the sidewall opening, the pump vane means mounted on the lip.

19. A mist pump as recited in claim 17 further comprising:

a ring wall having an inner diameter surface defining an opening and an outer diameter surface, the ring wall positioned normal to the longitudinal axis and spaced radially inward from the sidewall, and the ring wall connected to the pump vane means; and an annular space defined between the ring wall outer diameter surface and the sidewall interior surface.

20. A mist pump as recited in claim 17, further comprising:

a lip extending radially inward from a distal end of the sidewall, the lip terminating at a circumferential surface, the circumferential surface defining the opening to the feed chamber, the pump vane means mounted on the lip;

a ring wall having an inner diameter surface defining an opening and an outer diameter surface, the ring wall positioned normal to the longitudinal axis, parallel to the lip, spaced radially inward from the sidewall, and connected to the pump vane means; and an annular space defined between the ring wall outer diameter surface and the sidewall interior surface.

21. A mist pump as recited in claim 20, further comprising a plurality of accelerating vanes extending radially inward from the interior surface of the sidewall, the accelerating vanes being connected to the ring wall, the accelerating vanes providing a centrifugal force to the feed mixture as the feed chamber rotates.

22. A mist pump as recited in claim 21, wherein the plurality of accelerating vane means are oriented in a plane including the longitudinal axis.

23. A mist pump as recited in claim 21, wherein the plurality of accelerating vanes are oriented in a plane intersected by the longitudinal axis.

24. A mist pump as recited in claim 21, wherein the accelerating vanes are oriented in a plane parallel to the longitudinal axis.

25. A mist pump as recited in claim 21, wherein the accelerating vane means are curved.

26. A mist pump as recited in claim 20, wherein the pump vane means are oriented so that the pump vane means are in a plane including the longitudinal axis.

27. A mist pump as recited in claim 20, wherein the pump vane means are oriented so that the pump vane means are in a plane parallel to the longitudinal axis.

28. A mist pump as recited in claim 20, wherein the pump vane means are on so that the pump vane means are in a plane intersected by the longitudinal axis.

29. A mist pump as recited in claim 20, wherein the pump vane means are curved.

30. A mist pump as recited in claim 17, further comprising: a ring wall having an inner diameter surface defining an opening and an outer diameter surface, the ring wall positioned normal to the longitudinal axis and spaced radially inward from the interior surface of the sidewall, the ring wall being connected to the pump vane means, and the pump vane means being connected to the sidewall.

31. A mist pump as recited in claim 17 further comprising: a plurality of accelerating vane means extending radially inward from the interior edge of the sidewall and being connected to the pump vane means forming connected pump vane means and accelerating vane means, the accelerating vanes providing a centrifugal force to the feed mixture as the feed chamber rotates, and the pump vane means being connected to the sidewall, a space being defined between the connected pump vane means and accelerating vanes and the sidewall interior surface.

32. A mist pump as recited in claim 31, wherein the pump vane means are oriented so that the pump vane means are in a plane including the longitudinal axis.

33. A mist pump as recited in claim 31, wherein the pump vane means are oriented in a plane parallel to the longitudinal axis.

34. A mist pump as recited in claim 31, wherein the pump vane means are oriented in a plane intersected by the longitudinal axis.

35. A mist pump as recited in claim 31, wherein the plurality of accelerating vines are oriented in a plane including the longitudinal axis.

36. A mist pump as recited in claim 31, wherein the plurality of accelerating vanes are oriented in a plane intersected by the longitudinal axis.

37. A mist pump as recited in claim 31, wherein the accelerating vanes are oriented in a plane parallel to the longitudinal axis.

38. A mist pump as recited in claim 31, wherein the pump vane means are curved.

39. A mist pump as recited in claim 31, wherein the accelerating vane means are curved.

40. A conveyor for a decanter centrifuge, the conveyor adapted for rotation about its central longitudinal axis, the conveyor adapted to receive a feed pipe extending along the longitudinal axis, the conveyor comprising:

a central hub;

a helical conveyor flight extending along at least a portion of the length of the hub; and a feed chamber within the hub for receiving a feed mixture from the feed pipe and for delivering the feed mixture to the bowl, the feed chamber having a sidewall including an inner surface and being coaxially positioned about the longitudinal axis, an opening in the feed chamber sidewall for receiving the feed pipe, a space being defined between the feed pipe and the opening, and a plurality of pump vane means positioned and spaced radially inward from a portion of the sidewall adjacent to the sidewall opening for providing a centrifugal force to the feed mixture as the pump vane means rotate along with the conveyor and for drawing the mixture radially outward from the space between the feed pipe and the sidewall opening and for returning the feed mixture into the space between the sidewall and the radially outer surface of the pump vane means and back into the feed chamber radially outward from the pipe, an unobstructed annular area defined between the radially inner surface of the pump vane means and the feed pipe extending from the sidewall opening to a distal end of the pump vane means.

41. A conveyor as recited in claim 40 further comprising:

a lip extending radially inward from a distal end of the feed chamber sidewall, the lip terminating at a circumferential surface, the circumferential surface defining the opening to the feed chamber.

42. A conveyor as recited in claim 40 further comprising:

a ring wall having an inner diameter surface defining an opening and an outer diameter surface, the ring wall positioned normal to the longitudinal axis and spaced radially inward from the sidewall, and the ring wall connected to the pump vane means; and an annular space defined between the ring wall outer diameter surface and the sidewall interior surface.

43. A conveyor as recited in claim 40, further comprising:

a lip extending radially inward from a distal end of the sidewall, the lip terminating at a circumferential surface, the circumferential surface defining the opening to the feed chamber for the feed pipe, the pump vane means mounted on the lip;

a ring wall having an inner diameter surface defining an opening and an outer diameter surface, the ring wall positioned normal to the longitudinal axis, parallel to the lip, spaced radially inward from the sidewall, and connected to the pump vane means.

44. A conveyor as recited in claim 43, further comprising a plurality of accelerating vane means extending radially inward from the interior surface of the sidewall of the feed chamber, the accelerating vanes being connected to the ring wall, the accelerating vanes providing a centrifugal force to the feed mixture as the feed chamber rotates.

45. A conveyor as recited in claim 44, wherein the plurality of accelerating vanes are oriented in a plane including the longitudinal axis.

46. A conveyor as recited in claim 44, wherein the plurality of accelerating vanes are oriented in a plane intersected by the longitudinal axis.

47. A mist pump as recited in claim 44, herein the accelerating vanes are oriented in a plane parallel to the longitudinal axis.

48. A conveyor as recited in claim 44, wherein the accelerating vanes are curved.

49. A conveyor as recited in claim 43, wherein the pump vane means are oriented so that the pump vane means are in a plane including longitudinal axis.

50. A conveyor as recited in claim 43, wherein the pump vane means are oriented so that the pump vane means are in a plane parallel to the longitudinal axis.

51. A conveyor as recited in claim 43, wherein the pump vane means are oriented in a plane intersected by the longitudinal axis.

52. A mist pump as recited in claim 43, wherein the pump vane means are curved.

53. A conveyor as recited in claim 40 further comprising: a ring all having a radially inner diameter surface defining an opening and a radially outer diameter surface, the ring wall positioned normal to the longitudinal axis and spaced radially inward from the inner surface of the sidewall, the ring wall being connected to the pump vane means.

54. A conveyor as recited in claim 40 further comprising: a plurality of accelerating vane means extending radially inward from the interior surface of the sidewall, and being connected to the pump vane means forming connected pump vane means and accelerating vanes, the accelerating vane means providing a centrifugal force to the feed mixture as the feed chamber rotates, and defining a space between the connected pump vane means and accelerating vanes and the sidewall interior surface.

55. A conveyor as recited in claim 54, wherein the pump vane means are oriented in a plane including the longitudinal axis.

56. A conveyor as recited in claim 54, wherein the pump vane means are oriented in a plane parallel to the longitudinal axis.

57. A conveyor as recited in claim 54, wherein the pump vane means are oriented in a plane intersected by the longitudinal axis.

58. A conveyor as recited in claim 54, wherein the plurality of accelerating vanes are oriented in a plane including the longitudinal axis.

59. A conveyor as recited in claim 54, wherein the plurality of accelerating vanes are oriented in a plane intersected by the longitudinal axis.

60. A conveyor as recited in claim 54, wherein the accelerating vanes are oriented in a plane parallel to the longitudinal axis.

61. A conveyor as recited in claim 54, wherein the pump vane means are curved.

62. A conveyor as recited in claim 54, wherein the accelerating vanes are curved.

63. A decanter centrifuge for applying centrifugal force to a feed mixture, the centrifugal force created by rotation of the centrifuge, the centrifuge comprising:

a bowl rotatable about its longitudinal axis, the bowl having discharge ports therein;

a feed pipe for introducing the feed mixture into the bowl, the feed pipe extending longitudinally into the feed chamber and terminating at a feed pipe termination point; and a rotatable conveyor mounted within the centrifuge bowl and adapted for rotation at a differential speed with respect to the bowl, the conveyor having a central hub extending for at least a portion of the longitudinal length of the centrifuge, a helical conveyor flight extending along at least a portion of the length of the hub, and a feed chamber within the hub for receiving a feed mixture from the feed pipe, the feed chamber delivering the feed mixture into the bowl, the feed chamber having a sidewall including an interior surface and being coaxially positioned about the longitudinal axis, an opening in the feed chamber sidewall for receiving the feed pipe, a space defined between the feed pipe and the opening, and a plurality of pump vanes located radially inward from a portion of the sidewall and defining a space between at least a portion of a radially outer surface of the pump vanes and an adjacent portion of the inner surface of the sidewall at a position proximal to the sidewall opening, the pump vanes having a first end mounted on a portion of the sidewall and a second end extending longitudinally from the first end and terminating at a point within the feed chamber, the space between the portion of the pump vanes and the sidewall being defined therebetween, the pump vanes providing a centrifugal force to the feed mixture as the pump vanes rotate along with the conveyor about the longitudinal axis, the pump vanes, due to their proximity to the feed pipe and the space between the portion of the pump vanes and adjacent portion of the sidewall, drawing feed mixture from the space between the feed pipe and the sidewall opening and returning feed mixture back into the feed chamber radially outward from the pipe, an unobstructed annular area defined between the radially inner surface of the pump vanes and the feed pipe extending from the sidewall opening to said second end of the pump vanes.

* * * * *